US012140388B2

(12) United States Patent
Gao et al.

(10) Patent No.: US 12,140,388 B2
(45) Date of Patent: Nov. 12, 2024

(54) FLAT TUBE AND HEAT EXCHANGER PROVIDED WITH SAME

(71) Applicant: SANHUA (HANGZHOU) MICRO CHANNEL HEAT EXCHANGER CO., LTD., Zhejiang (CN)

(72) Inventors: Ying Gao, Zhejiang (CN); Chaochao Zhang, Zhejiang (CN); Qiang Gao, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 438 days.

(21) Appl. No.: 17/599,876

(22) PCT Filed: Apr. 2, 2020

(86) PCT No.: PCT/CN2020/083012
§ 371 (c)(1),
(2) Date: Sep. 29, 2021

(87) PCT Pub. No.: WO2020/200285
PCT Pub. Date: Oct. 8, 2020

(65) Prior Publication Data

US 2022/0196344 A1 Jun. 23, 2022

(30) Foreign Application Priority Data

Apr. 2, 2019 (CN) ..... 201910262715.7
Apr. 2, 2019 (CN) ..... 201920440200.7

(51) Int. Cl.
*F28F 9/02* (2006.01)
*F25B 39/00* (2006.01)
(Continued)

(52) U.S. Cl.
CPC ..... *F28F 9/02* (2013.01); *F25B 39/00* (2013.01); *F28D 1/0435* (2013.01);
(Continued)

(58) Field of Classification Search
CPC ..... F25B 39/00; F28D 1/0435; F28D 1/0471; F28D 1/05366; F28F 9/02; F28F 1/022; F28F 1/025; F28F 1/126; F28F 2280/00
See application file for complete search history.

(56) References Cited

U.S. PATENT DOCUMENTS 10,816,277 B2 * 10/2020 Dziubinschi ..... F28D 1/0391
2013/0240187 A1 * 9/2013 Hamaguchi ..... F28F 1/30 165/150
(Continued)

FOREIGN PATENT DOCUMENTS

CN 103148729 A 6/2013
CN 103890532 A 6/2014
(Continued)

OTHER PUBLICATIONS

Ouzhou, "OA for CN application 201910262715.7", Mar. 14, 2024.

*Primary Examiner* — Ljiljana V. Ciric
(74) *Attorney, Agent, or Firm* — Bridgeway IP Law Group, PLLC; Jihun Kim

(57) ABSTRACT

A flat tube included in a heat exchanger has a first end and a second end spaced apart in a length direction of the flat tube, and a first side surface and a second side surface spaced apart in a width direction of the flat tube. The first side surface and the second side surface of the first end are provided with a first concave part and a second concave part, respectively. The first concave part and the second concave part have a first length and a second length that extend from an end surface of the first end in the length direction of the flat tube, and have a first depth and a second depth that
(Continued)

extend in the width direction of the flat tube. The first length is not equal to the second length.

9 Claims, 10 Drawing Sheets

(51) Int. Cl.

| | |
|---|---|
| ***F28D 1/04*** | (2006.01) |
| ***F28D 1/047*** | (2006.01) |
| ***F28D 1/053*** | (2006.01) |
| ***F28F 1/02*** | (2006.01) |
| ***F28F 1/12*** | (2006.01) |

(52) U.S. Cl.
CPC ..... *F28D 1/0471* (2013.01); *F28D 1/05366* (2013.01); *F28F 1/022* (2013.01); *F28F 1/025* (2013.01); *F28F 1/126* (2013.01); *F28F 2280/00* (2013.01)

(56) References Cited

U.S. PATENT DOCUMENTS

| | | | | |
|---|---|---|---|---|
| 2018/0245817 | A1 | 8/2018 | Okuda et al. | |
| 2020/0132378 | A1* | 4/2020 | Dong | F28D 1/0391 |
| 2021/0310742 | A1* | 10/2021 | Zhao | F28F 1/08 |
| 2022/0074670 | A1* | 3/2022 | Wei | F28F 1/025 |

FOREIGN PATENT DOCUMENTS

| | | | | | |
|---|---|---|---|---|---|
| CN | 103925745 | A | | 7/2014 | |
| CN | 205383928 | U | | 7/2016 | |
| CN | 105683639 | B | | 1/2018 | |
| CN | 104949394 | B | * | 5/2019 | |
| CN | 209910481 | U | | 1/2020 | |
| EP | 3141858 | A1 | * | 3/2017 | F28D 1/047 |
| JP | 2018159527 | A | | 10/2018 | |
| WO | 2019017093 | A1 | | 1/2019 | |

* cited by examiner

FLAT TUBE AND HEAT EXCHANGER PROVIDED WITH SAME

CROSS-REFERENCE TO RELATED APPLICATION

The present disclosure is based on and claims priority to Chinese Patent Applications No. 201920440200.7 and 201910262715.7 filed on Apr. 2, 2019, the entire contents of which are incorporated herein by reference.

FIELD

This application relates to the field of heat exchange technologies, and specifically, to a flat tube and a heat exchanger provided with the flat tube.

BACKGROUND

In the related art, two longitudinal sides of a flat tube of a parallel-flow heat exchanger are symmetrical to each other. In order to improve heat exchange efficiency and reliability, the flat tube is closer to an outer wall of one side of a header in a radial direction during installation and connection of the header. This hinders positioning of a junction between the flat tube and the header during the installation, causing stress concentration in the flat tube, and thereby affecting reliability of the heat exchanger.

SUMMARY

An objective of the present application is to solve at least one of technical problems existing in the prior art. Therefore, the present application proposes a flat tube, which is used in a parallel-flow heat exchanger, and helps reduce stress concentration especially when the flat tube is used in a parallel-flow heat exchanger in which the flat tube is closer to one side of a header, thereby improving reliability of the heat exchanger.

The present application further proposes a heat exchanger provided with the flat tube.

In order to achieve the foregoing objectives, according to an embodiment of a first aspect of the present application, a flat tube is provided. The flat tube has a first end section and a second end section that are spaced apart in a length direction of the flat tube, and the flat tube has a first side surface and a second side surface that are spaced apart in a width direction of the flat tube. The first side surface of the first end section of the flat tube is provided with a first concave part, and the second side surface of the first end section of the flat tube is provided with a second concave part. The first concave part has a first length extending from an end surface of the first end section of the flat tube in the length direction of the flat tube and a first depth extending in the width direction of the flat tube. The second concave part has a second length extending from an end surface of the first end section of the flat tube in the length direction of the flat tube and a second depth extending in the width direction of the flat tube. The first length is not equal to the second length.

The flat tube according to this embodiment of the present application is used in a parallel-flow heat exchanger, and has advantages such as reducing stress concentration, and improving reliability of the heat exchanger.

In some other embodiments of the present disclosure, a flat tube is provided. The flat tube has a first end section and a second end section that are spaced apart in a length direction of the flat tube, and the flat tube has a first side surface and a second side surface that are spaced apart in a width direction of the flat tube. The first end section of the first side surface of the flat tube is provided with a first concave part, and the second end section of the first side surface of the flat tube is provided with a third concave part. The first concave part has a first length extending from an end surface of the first end section of the flat tube in the length direction of the flat tube and a first depth extending in the width direction of the flat tube. The third concave part has a third length extending from an end surface of the second end section of the flat tube in the length direction of the flat tube and a third depth extending in the width direction of the flat tube. The first length is equal to the third length.

The flat tube according to this embodiment of the present application is used in a parallel-flow heat exchanger, and has advantages such as reducing stress concentration and improving reliability.

In some other embodiments of the present disclosure, a heat exchanger is provided. The heat exchanger includes: a first header, where the first header includes a plurality of openings spaced apart in a length direction of the first header; a second header, where the second header includes a plurality of openings spaced apart in a length direction of the second header, and the first header and the second header are spaced apart; and a flat tube, where the flat tube is the flat tube according to the first aspect or the second aspect of the present application, a first end section of the flat tube passes through the opening of the first header and is connected to the first header, and a second end section of the flat tube passes through the opening of the second header and is connected to the second header. In a cross section orthogonal to the length direction of the first header, in a width direction of the flat tube, a largest distance between a first side surface of the flat tube and an outer wall surface that is of the first header and that is on a side adjacent to the first side surface is less than a largest distance between a second side surface of the flat tube and an outer wall surface that is of the first header and that is on a side adjacent to the second side surface; and/or a largest distance between a first side surface of the flat tube and an outer wall surface that is of the second header and that is on a side adjacent to the first side surface is less than a largest distance between a second side surface of the flat tube and an outer wall surface that is of the second header and that is on a side adjacent to the second side surface.

According to the heat exchanger in this embodiment of the present application, during bending of the header, a bend radius can be reduced by using the flat tube according to the embodiment of the first aspect or the second aspect of the present application, and reliability of the heat exchanger can be improved.

Additional aspects and advantages of the present application are partially given in the following description, and some of them become obvious from the following description, or are understood through practice of the present application.

BRIEF DESCRIPTION OF THE DRAWINGS

The foregoing and/or additional aspects and advantages of the present application become obvious and easy to understand from the description of the embodiments with reference to the following accompanying drawings.

DETAILED DESCRIPTION

Figure 1:
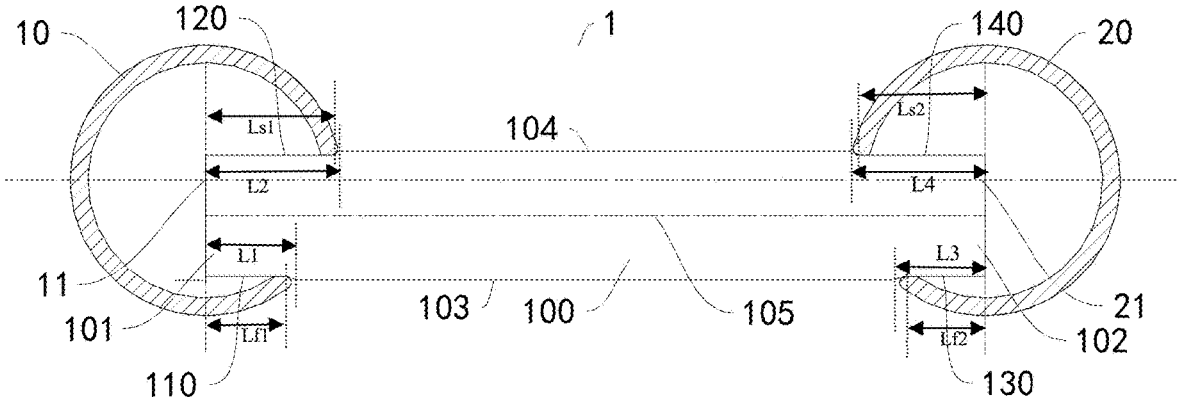
FIG. 1 is a cutaway drawing of a heat exchanger according to a specific embodiment of the present application.
Figure 2:
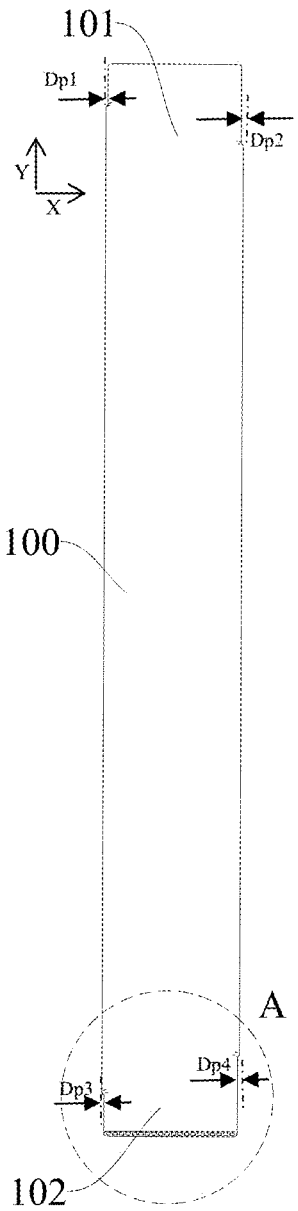
FIG. 2 is a schematic structural diagram of a heat exchange tube of the heat exchanger in FIG. 1.
Figure 3:
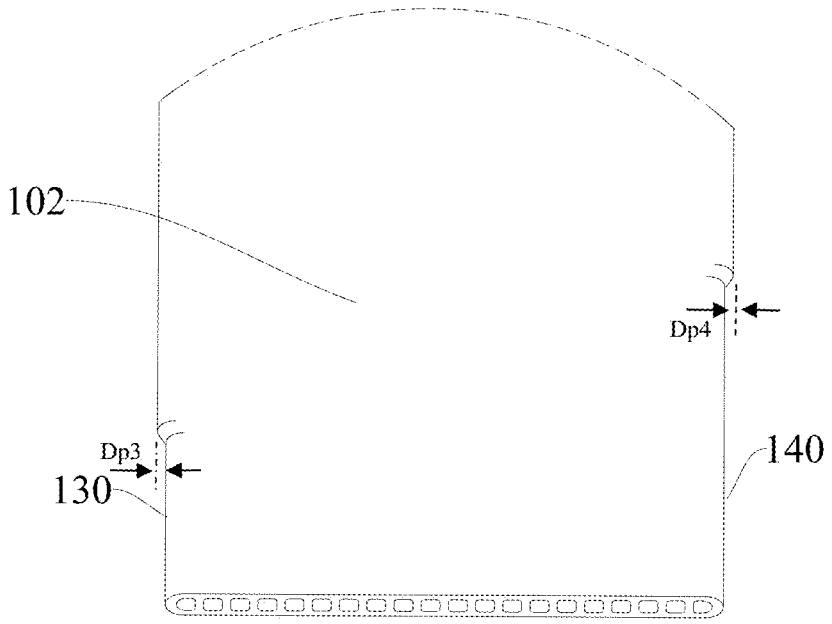
FIG. 3 is a partially enlarged view of A in FIG. 2.
Figure 4:
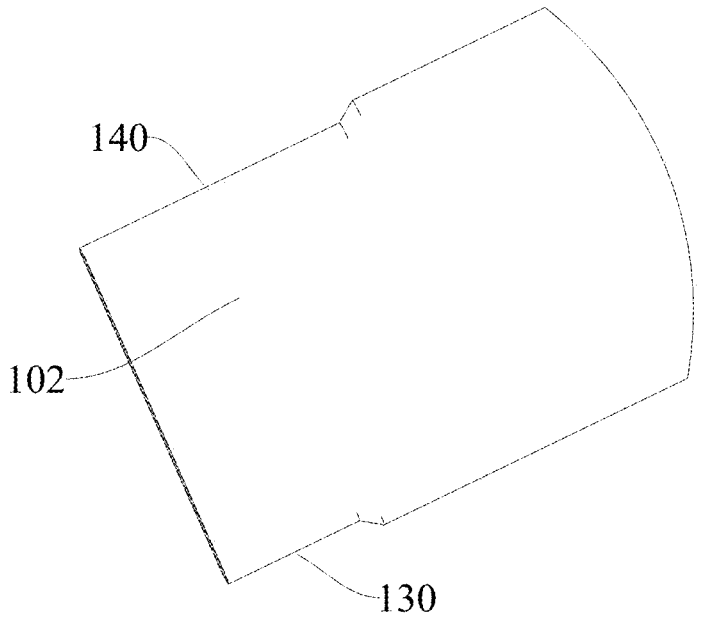
FIG. 4 is a schematic main view of the heat exchange tube in FIG. 3.
Figure 5:
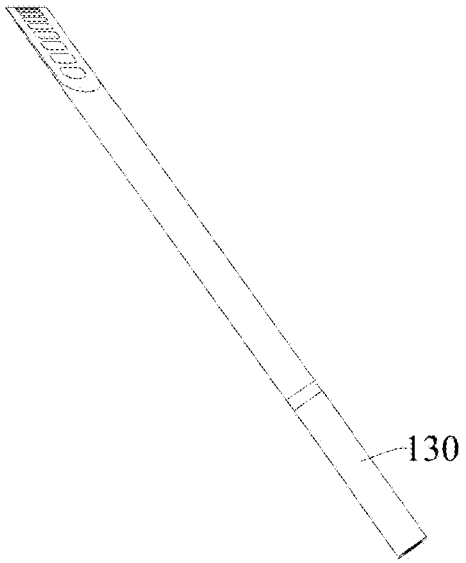
FIG. 5 is a schematic view of the heat exchange tube in FIG. 3 from another angle

Embodiments of the present application are described in detail below, and examples of the embodiments are shown in the accompanying drawings. Throughout the accompanying drawings, a same or similar number denotes a same or similar element or an element with a same or similar function. The embodiments described below with reference to the accompanying drawings are examples, and are merely intended to explain the present application, but shall not be understood as a limitation on the present application.

In the description of the present application, it should be understood that an orientation or positional relationship indicated by the term "center", "longitudinal", "transverse", "length", "width", "thickness", "upper", "lower", "front", "back", "left", "right", "vertical", "horizontal", "top", "bottom", "internal", "external", "clockwise", "counterclockwise", "axial direction", "radial direction", "circumferential direction", or the like is based on an orientation or positional relationship shown in the accompanying drawings, and is merely for ease of describing the present application and simplifying the description, but does not indicate or imply that an apparatus or element referred to must have a specific orientation or be constructed and operated in a specific orientation, and therefore cannot be understood as a limitation on the present application. In addition, the features defined with "first" and "second" may explicitly or implicitly include one or more of these features. In the description of the present application, unless otherwise specified, "a plurality of" means two or more.

In the description of the present application, it should be noted that, unless otherwise expressly specified or defined, terms such as "install", "connect", and "connected to" should be understood in a broad sense. For example, a "connection" may be a fixed connection, may be a detachable connection, or may be an integrated connection; or may be a mechanical connection, or an electrical connection; or may be a direct connection, or an indirect connection through an intermediate medium; or may be an internal connection between two elements. Those of ordinary skill in the art can understand specific meanings of the foregoing terms in the present application with reference to specific circumstances.

The following describes a flat tube 100 according to some embodiments of the present application with reference to the accompanying drawings.

As shown in FIG. 1 to FIG. 6, the flat tube 100 according to the embodiments of the present application has a first end section 101 and a second end section 102 that are spaced apart in a length direction Y of the flat tube 100, and a cross section C of the flat tube 100 is a rectangle, square, or ellipse. In addition, the flat tube 100 has a first side surface 103 and a second side surface 104 spaced apart along the width direction X of the flat tube 100. The first side surface 103 of the first end section 101 is provided with a first concave part 110. The second side surface 104 of the first end section 101 is provided with a second concave part 120. The first concave part 110 has a first length L1 extending from an end surface of the first end section 101 in a length direction Y of the flat tube 100 and has a first depth Dp1 extending in a width direction X of the flat tube. The second concave part 120 has a second length L2 extending from an end surface of the first end section 101 in the length direction Y of the flat tube 100 and has a second depth Dp2 extending in the width direction X of the flat tube 100. The first length L1 is not equal to the second length L2.

According to the flat tube 100 of the embodiments of the present application, the first concave part 110 and the second concave part 120 are arranged on the flat tube 100, so as to perform positioning for cooperative installation of the flat tube 100 and a header by using the first concave part 110 and the second concave part 120. Specifically, the first concave part 110 and the second concave part 120 can be used to abut against a wall of the header, so as to confirm whether the flat tube 100 is installed in place during installation, and after the installation, an effect of positioning between the flat tube 100 and the header can be improved, thereby improving stability of the flat tube 100 and the header.

In addition, arrangement of the first concave part 110 and the second concave part 120 can reduce a width of a portion through which the flat tube 100 is inserted into the header, thereby facilitating control of a tube diameter of the header, and reducing refrigerant charging.

Moreover, the length of the first concave part 110 is not equal to that of the second concave part 120, so as to eccentrically install the flat tube 100 on the header, and to stagger a center line passing through a width-direction center of the flat tube 100 and a center line passing through a circle center of a radial section of the header (as shown in FIG. 1 to FIG. 7), so that the center of the width direction X of the flat tube 100 is offset by a predetermined distance from a center of a radial direction of the header. For example, the first concave part 110 and the second concave part 120 may each abut against the wall of the header. Compared with the related art in which a flat tube and a header are installed with their centers overlapped, an overlap of stress concentration positions of the flat tube and the header can be avoided, to prevent excess stress concentration at a junction between the flat tube 100 and the header after installation, and prolong a service life of the heat exchanger.

In addition, the center line passing through the width-direction center of the flat tube 100 and the center line passing through the circle center of the radial section of the header are staggered, to eccentrically install the flat tube 100 on the header, and during bending of the header, to reduce a bend radius of the flat tube 100, thereby mitigating impact of stretching or compression on the flat tube 100 during bending of the header, reducing possibility of cracking of a weld between the flat tube 100 and the header during bending of the header, and improving reliability of the heat exchanger.

Further, the length of the first concave part 110 is different from that of the second concave part 120, so as to improve cooperation on eccentric installation of the flat tube 100 on the header, so that the flat tube 100 is more suitable for the eccentric installation, thereby improving stability and reliability of the flat tube 100 after the installation.

Therefore, the flat tube 100 according to the embodiments of the present application has advantages such as reducing stress concentration, decreasing cracking occurrence of a weld between the flat tube and the header at a bend, and improving reliability.

The following describes a flat tube 100 according to a specific embodiment of the present application with reference to the accompanying drawings.

In some specific embodiments of the present application, as shown in FIG. 1 to FIG. 6, the flat tube 100 according to this embodiment of the present application has a first end section 101 and a second end section that are spaced apart in a length direction Y of the flat tube 100. In addition, the flat tube 100 has a first side surface 103 and a second side surface 104 that are spaced apart in a width direction X of the flat tube 100. The first side surface 103 of the first end section 101 is provided with a first concave part 110, and the second side surface 104 of the first end section 101 is provided with a second concave part 120. The first concave part 110 has a first length L1 extending from an end surface of the first end section 101 in the length direction Y of the flat tube 100 and has a first depth Dp1 extending in the width direction X of the flat tube. The second concave part 120 has a second length L2 extending from an end surface of the first end section 101 in the length direction Y of the flat tube 100 and has a second depth Dp2 extending in the width direction X of the flat tube 100. The first length L1 is not equal to the second length L2.

Advantageously, as shown in FIG. 1 to FIG. 6, the first side surface 103 of the second end section 102 is provided with a third concave part 130, and the third concave part 130 has a third length L3 extending from an end surface of the second end section 102 in the length direction Y of the flat tube 100 and has a third depth Dp3 extending in the width direction X of the flat tube 100. In this way, the second end section 102 of the flat tube 100 can be positioned by using the third concave part 130, to facilitate eccentric connection between the second end section 102 of the flat tube 100 and a header, thereby improving stability and reliability of the flat tube 100.

Specifically, as shown in FIG. 1 to FIG. 6, the first length L1 is equal to the third length L3. In this way, dimensions of the flat tube 100 can be more regular, and it is easy for processing and storage.

More advantageously, as shown in FIG. 1 to FIG. 6, the second side surface 104 of the second end section 102 is provided with a fourth concave part 140, and the fourth concave part 140 has a fourth length L4 extending from the end surface of the second end section 102 in the length direction Y of the flat tube 100 and has a fourth depth Dp4 extending in the width direction X of the flat tube 100. In this way, the second end section 102 of the flat tube 100 can be positioned by using the third concave part 130 and the fourth concave part 140, to further facilitate eccentric connection between the second end section 102 of the flat tube 100 and the header, thereby improving stability and reliability of the flat tube 100.

More specifically, as shown in FIG. 1 to FIG. 6, the second length L2 is equal to the fourth length L4. In this way, the dimensions of the flat tube 100 can be more regular, and it is easy for processing and storage. In addition, a length of the fourth concave part 140 can be greater than that of the third concave part 130, so as to facilitate positioning of the second end section 102.

Figure 6:
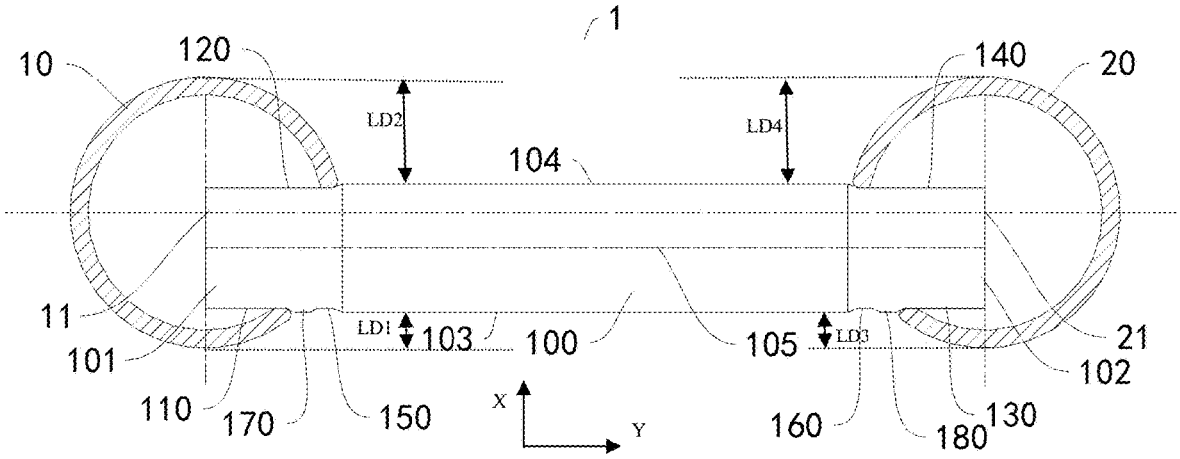
FIG. 6 is a cutaway drawing of a heat exchanger according to another specific embodiment of the present application.

FIG. 6 shows the flat tube 100 according to a specific embodiment of the present application. As shown in FIG. 6, the second length L2 is greater than the first length, the first side surface 103 of the first end section 101 of the flat tube 100 is provided with a fifth concave part 150, and a first protrusion 170 is included between the fifth concave part 150 and the first concave part 110 in the length direction Y of the flat tube 100. The fifth concave part 150 has a fifth length extending in the length direction Y of the flat tube 100 and a fifth depth extending in the width direction X of the flat tube 100. In this way, the first end section 101 of the flat tube 100 can be positioned by using both the first protrusion 170 and the second concave part 120, and arrangement of the fifth concave part 150 can facilitate concurrent processing on two side surfaces of the flat tube 100, thereby reducing processing difficulty of the flat tube 100, and improving production efficiency of the flat tube 100.

Specifically, as shown in FIG. 6, a sum of the first length, the fifth length, and a length of the first protrusion 170 in the length direction Y of the flat tube is equal to the second length L2. In this way, a shape of the flat tube 100 can be more regular, further facilitating processing of the flat tube 100.

Advantageously, as shown in FIG. 6, the second length is greater than the first length, and the first side surface 103 of the first end section 101 of the flat tube 100 is provided with the fifth concave part 150. The first protrusion 170 is included between the fifth concave part 150 and the first concave part 110 in the length direction Y of the flat tube 100. The fifth concave part 150 has the fifth length extending in the length direction Y of the flat tube 100 and the fifth depth extending in the width direction X of the flat tube 100. The fourth length is greater than the third length, and the first side surface of the second end section 102 of the flat tube 100 is provided with a sixth concave part 160. A second protrusion 180 is included between the sixth concave part 160 and the third concave part 130 in the length direction Y of the flat tube 100. The sixth concave part 160 has a sixth length extending in the length direction Y of the flat tube 100 and a sixth depth extending in the width direction X of the flat tube 100. In this way, the first end section 101 of the flat tube 100 can be positioned by using both the first protrusion 170 and the second concave part 120, and the second end section 102 of the flat tube 100 can be positioned by using both the second protrusion 180 and the fourth concave part 140. In addition, arrangement of the fifth concave part 150 and the sixth concave part 160 can facilitate concurrent processing on two side surfaces of the flat tube 100, thereby reducing processing difficulty of the flat tube 100, and improving production efficiency of the flat tube 100.

More advantageously, as shown in FIG. 6, the sum of the first length, the fifth length, and the length of the first protrusion 170 in the length direction Y of the flat tube 100 is equal to the second length, and a sum of the six length, the third length, and a length of the second protrusion 180 in the length direction Y of the flat tube 100 is equal to the fourth length. In this way, the shape of the flat tube 100 can be more regular, further facilitating processing of the flat tube 100.

More specifically, as shown in FIG. 1 to FIG. 6, a ratio of the second length L2 to the first length L1 is 1 to 2.5. In this way, impact of a too large length difference between the first length and the second length L2 on a positioning effect of the flat tube 100 can be avoided.

Those skilled in the art can understand that a ratio of the fourth length L4 to the third length L3 is also 1 to 2.5.

The following describes a flat tube 100 according to some other embodiments of the present application with reference to the accompanying drawings.

Figure 7:
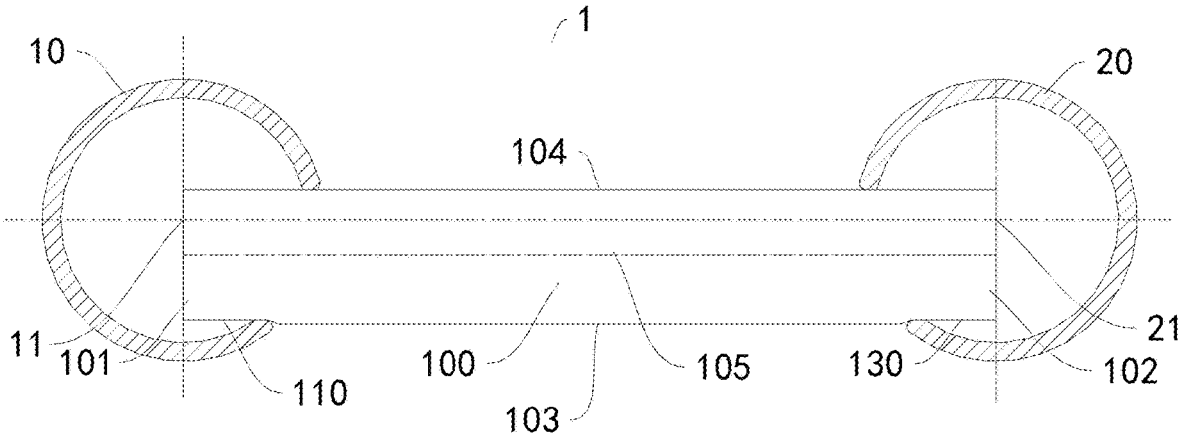
FIG. 7 is a cutaway drawing of a heat exchanger according to another specific embodiment of the present application.
Figure 8:
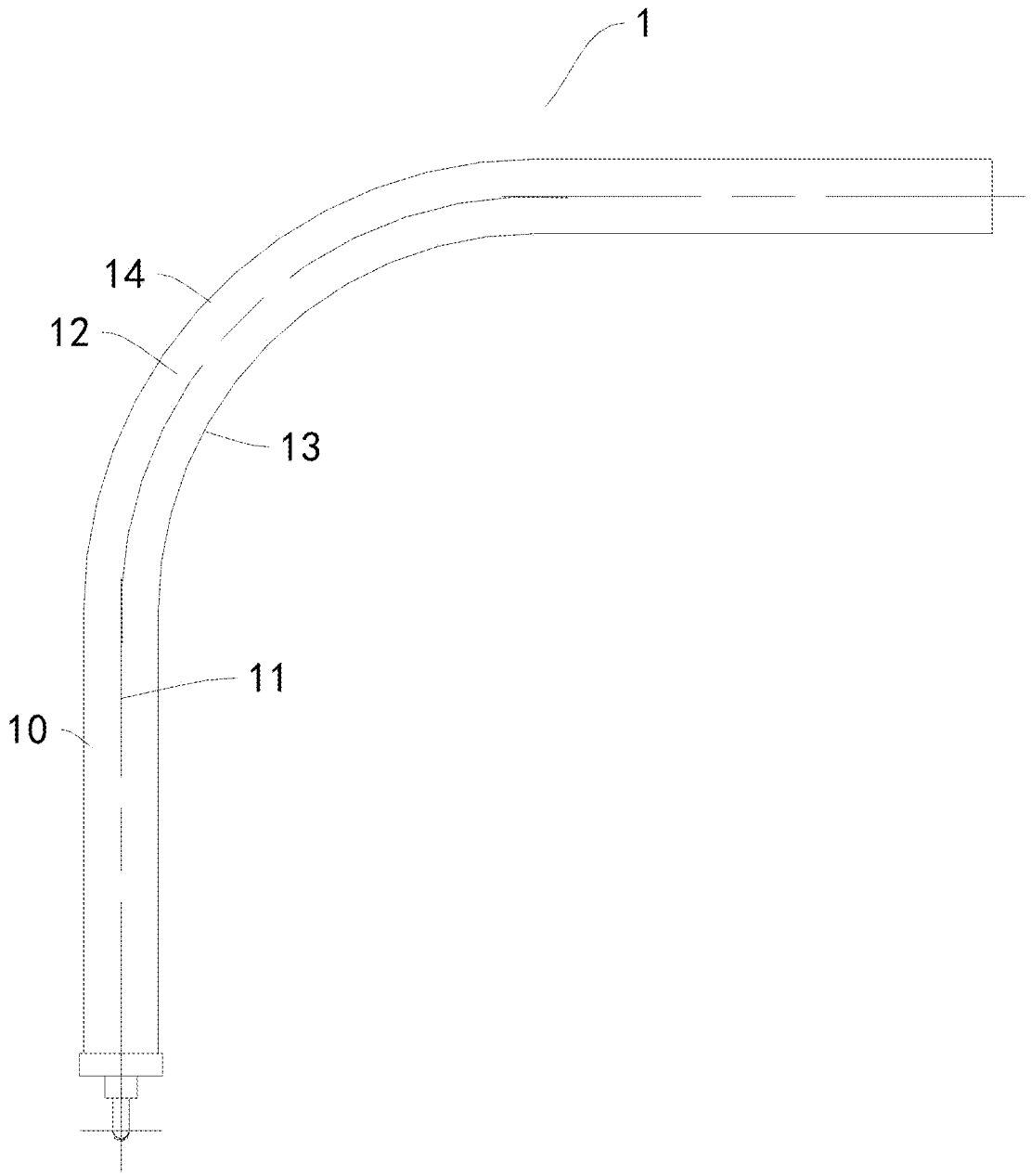
FIG. 8 is a schematic structural diagram of a heat exchanger in some embodiments of the present disclosure.
Figure 9:
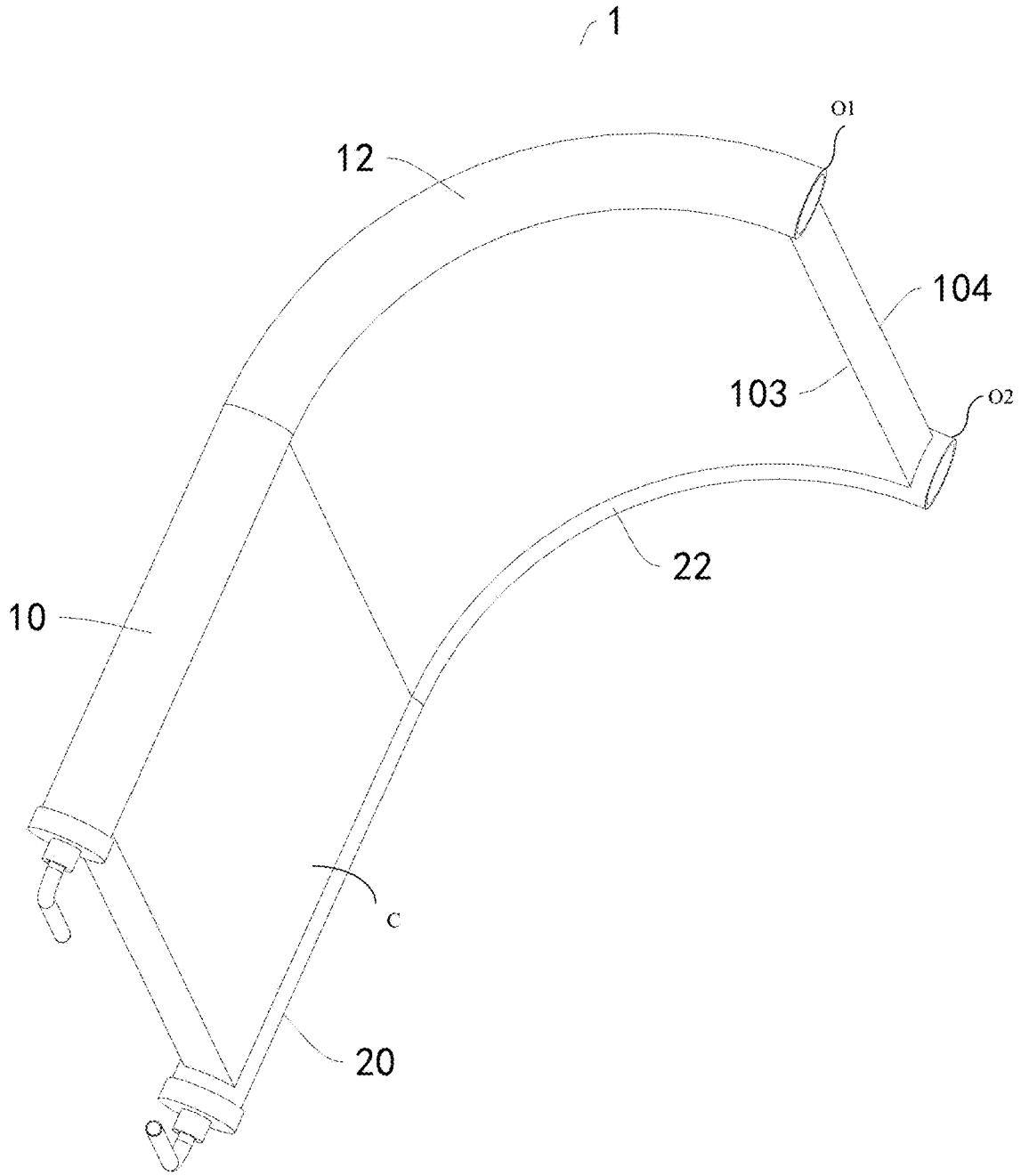
FIG. 9 is a schematic diagram of a partial structure of a heat exchanger in some embodiments of the present disclosure.
Figure 10:
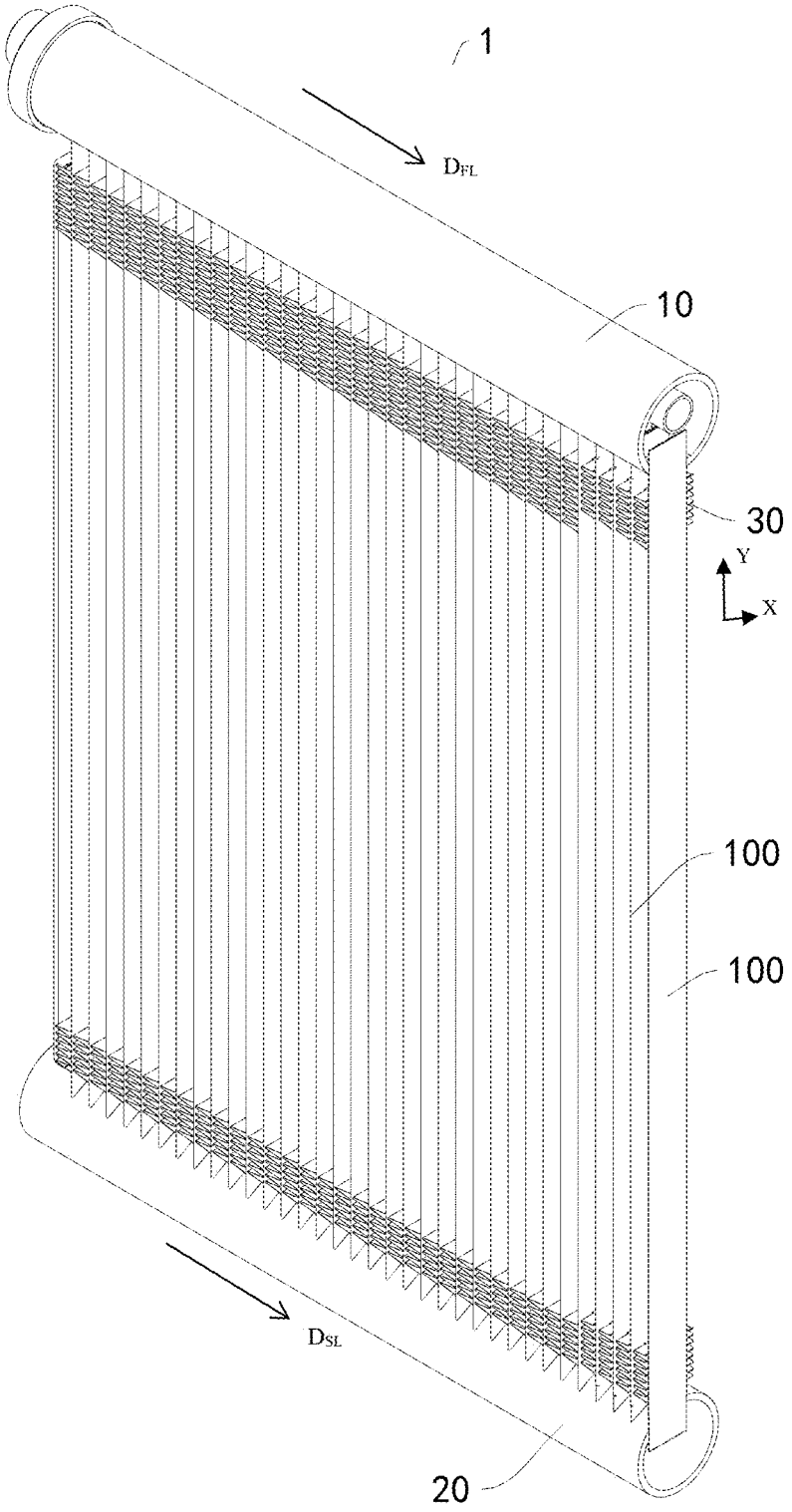
FIG. 10 is a schematic structural diagram of a heat exchanger in some embodiments of the present disclosure.
Figure 11:
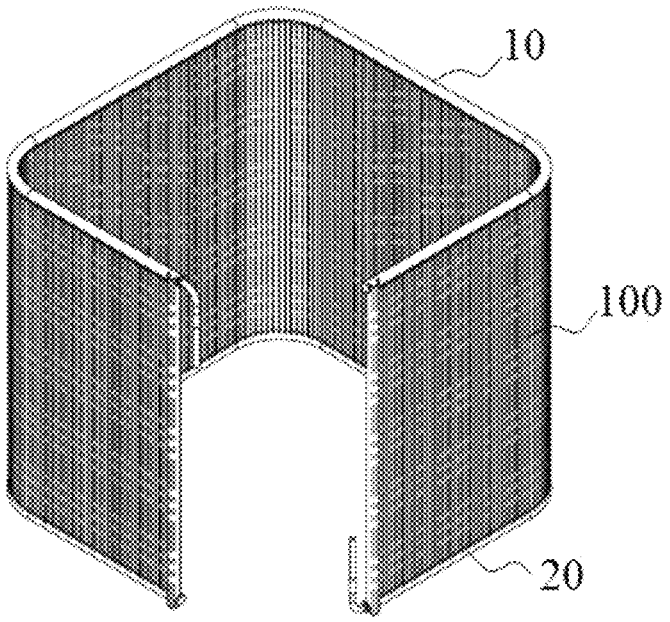
FIG. 11 is a schematic structural diagram of a heat exchanger in some embodiments of the present disclosure.
Figure 12A:
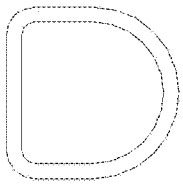
FIG. 12A is a sectional view of the first and second headers of D-shaped tubes.
Figure 12B:
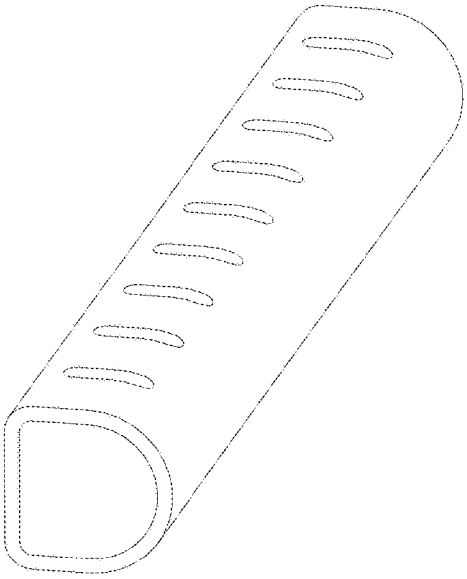
FIG. 12B is a schematic structural diagram of the first and second headers of D-shaped tubes.
Figure 13A:
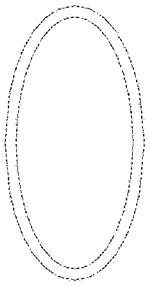
FIG. 13A is a sectional view of the first and second headers of elliptical tubes.
Figure 13B:
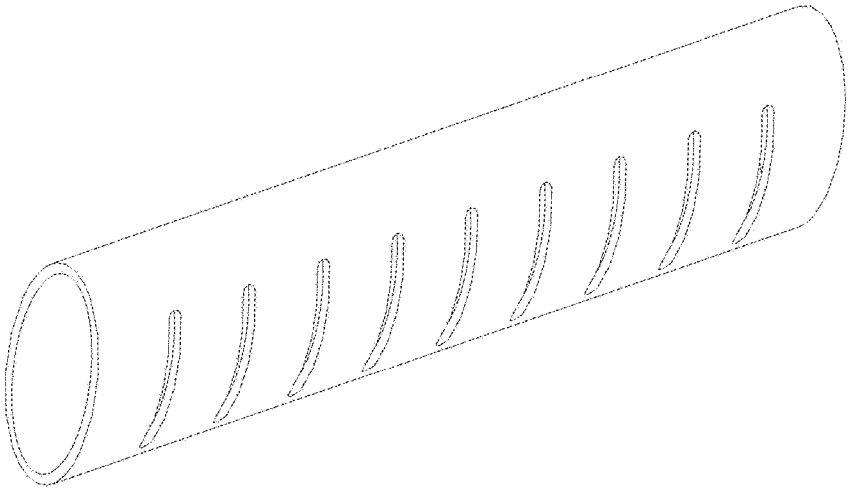
FIG. 13B is a schematic structural diagram of the first and second headers of elliptical tubes.

As shown in FIG. 7, the flat tube 100 according to the embodiments of the present application has a first end section 101 and a second end section 102 that are spaced apart in a length direction of the flat tube 100, and the flat tube 100 has a first side surface 103 and a second side surface 104 that are spaced apart in a width direction of the flat tube 100. The first end section 101 of the first side surface 103 is provided with a first concave part 110, and the second end section 102 of the first side surface 103 is provided with a third concave part 130. The first concave part 110 has a first length extending from an end surface of the first end section 101 in the length direction of the flat tube 100 and has a first depth extending in the width direction of the flat tube 100. The third concave part 130 has a third length extending from an end surface of the second end section 102 in the length direction of the flat tube 100 and has a third depth extending in the width direction of the flat tube 100.

According to the flat tube 100 of the embodiments of the present application, the first concave part 110 and the third concave part 130 are arranged on the flat tube 100, so as to perform positioning for cooperative installation of the two end sections of the flat tube 100 and a header by using the first concave part 110 and the third concave part 130. Specifically, the first concave part 110 and the third concave part 130 can be used to abut against a wall of the header, so as to confirm whether the flat tube 100 is installed in place during installation, and after the installation, an effect of positioning between the flat tube 100 and the header can be improved, thereby improving stability of the flat tube 100 and the header.

In addition, arrangement of the first concave part 110 and the third concave part 130 can reduce a width of a portion through which the flat tube 100 is inserted into the header, thereby facilitating control of a tube diameter of the header, and reducing refrigerant charging.

Moreover, the first concave part 110 and the third concave part 130 are arranged only on a single side surface of the flat tube 100, so as to eccentrically install the flat tube 100 on the header, and to stagger a center line passing through a width-direction center of the flat tube 100 and a center line passing through a circle center of a radial section of the header (as shown in FIG. 1 to FIG. 7), so that the center of the width direction X of the flat tube 100 is offset by a predetermined distance from a center of a radial direction of the header. For example, the first concave part 110 and the second side surface 104 of the flat tube 100 may respectively abut against the wall of the header. Compared with the related art in which a flat tube and a header are installed with their centers overlapped, an overlap of stress concentration positions of the flat tube and the header can be avoided, to prevent excess stress concentration at a junction between the flat tube 100 and the header after installation, and prolong a service life of the heat exchanger.

In addition, the center line passing through the width-direction center of the flat tube 100 and the center line passing through the circle center of the radial section of the header are staggered, to eccentrically install the flat tube 100 on the header, and during bending of the header, to reduce a bend radius of the flat tube 100, thereby mitigating impact of stretching or compression on the flat tube 100 during bending of the header, reducing possibility of cracking of a weld between the flat tube 100 and the header during bending of the header, and improving reliability of the heat exchanger.

Further, the first concave part 110 and the third concave part 130 are arranged only on a single side surface of the flat tube 100, so as to improve cooperation on eccentric installation of the flat tube 100 on the header, so that the flat tube 100 is more suitable for the eccentric installation, thereby improving stability and reliability of the flat tube 100 after the installation.

Therefore, the flat tube 100 according to the embodiments of the present application has advantages such as reducing stress concentration and improving reliability, and during further bending of the heat exchanger, can decrease cracking occurrence of the weld between the flat tube and the header at a bend.

The following describes a flat tube 100 according to a specific embodiment of the present application with reference to the accompanying drawings.

In some specific embodiments of the present application, as shown in FIG. 7, the flat tube 100 according to this embodiment of the present application has a first end section 101 and a second end section 102 that are spaced apart in a length direction of the flat tube 100, and the flat tube 100 has a first side surface 103 and a second side surface 104 that are spaced apart in a width direction of the flat tube 100. The first end section 101 of the first side surface 103 is provided with a first concave part 110, and the second end section 102 of the first side surface 103 is provided with a third concave part 130. The first concave part 110 has a first length extending from an end surface of the first end section 101 in the length direction of the flat tube 100 and has a first depth extending in the width direction of the flat tube 100. The third concave part 130 have a third length extending from an end surface of the second end section 102 in the length direction of the flat tube 100 and have a third depth extending in the width direction of the flat tube 100.

Specifically, as shown in FIG. 7, the first length is equal to the third length. In this way, dimensions of the flat tube 100 can be more regular, and it is easy for processing and storage.

Specifically, the first depth Dp1, the second depth Dp2, the third depth Dp3, and the fourth depth Dp4 may be equal to each other. In this way, a shape of the flat tube 100 can be more regular, facilitating processing of the flat tube 100.

Those skilled in the art can understand that the first depth Dp1, the second depth Dp2, the third depth Dp3, and the fourth depth Dp4 may not be equal to each other.

The following describes a heat exchanger 1 In some embodiments of the present disclosure. The heat exchanger 1 according to this embodiment of the present application includes a first header 10, a second header 20, and a flat tube. The first header 10 includes openings spaced apart in a length direction $D_{FL}$ of the first header 10. The second header 20 includes openings spaced apart in a length direction $D_{SL}$ of the second header 20, and the first header 10 and the second header 20 are arranged in parallel. The flat tube is the flat tube 100 according to the foregoing embodiment of the present application. A second end section 102 of the flat tube 100 passes through the opening of the first header 10 and is connected to the first header 10, and a second end section 102 of the flat tube 100 passes through the opening of the second header 20 and is connected to the second header 20.

In a cross section C orthogonal to the length direction $D_{FL}$, $D_{SL}$ of the first header 10 and the second header 20, in a width direction X of the flat tube 100, a largest distance LD1 between a first side surface 103 of the flat tube 100 and an outer wall surface that is of the first header 10 and that is on a side adjacent to the first side surface 103 is less than a largest distance LD2 between a second side surface 104 of the flat tube 100 and an outer wall surface that is of the first header 10 and that is on a side adjacent to the second side surface 104; and/or a largest distance LD3 between a first side surface 103 of the flat tube 100 and an outer wall surface that is of the second header 20 and that is on a side adjacent to the first side surface 103 is less than a largest distance LD4 between a second side surface 104 of the flat tube 100 and an outer wall surface that is of the second header 20 and that is on a side adjacent to the second side surface 104.

It needs to be understood herein that the heat exchanger 1 may include a plurality of flat tubes. Some of the plurality of flat tubes may be the flat tubes 100 according to the embodiments of the present application, and the other may be flat tubes in the related art, or all of them may be the flat tubes 100 according to the embodiments of the present application. A fin 30 may be provided between two adjacent flat tubes.

The heat exchanger 1 in this embodiment of the present application, by using the flat tube 100 according to the foregoing embodiment of the present application, has advantages such as reducing stress concentration, decreasing cracking occurrence of a weld between the flat tube and the header, and improving stability and reliability. Moreover, such a heat exchanger can reduce a bend radius and improve reliability of the heat exchanger during bending of the header.

In some embodiments, the first header 10 and the second header 20 are round tubes, elliptical tubes, or D-shaped tubes. In this way, applicability of the first header 10 and the second header 20 can be improved.

Specifically, as shown in FIG. 1 to FIG. 11, the first header 10 includes at least a first bent section 12, and the first end section 101 of the flat tube 100 is connected to the first bent section 12. The second header 20 includes at least a second bent section 22, and the second end section 102 of the flat tube 100 is connected to the second bent section 22, The second side surface 104 of the flat tube 100 is closer to an outer side O1 of the first bent section 12 than the first side surface 103, and/or the second side surface 104 of the flat tube 100 is closer to an outer side O2 of the second bent section 22 than the first side surface 103. In this way, the flat tube 100 can be offset to a squeezed side, thereby reducing a bend radius of the flat tube 100 during bending, reducing stress concentration of the flat tube 100 after the bending, avoiding cracking of the weld between the flat tube 100 and the header, and improving stability and reliability of the flat tube 100.

It should be understood herein that the outer sides O1, O2 of the first bent section 12 and the second bent section 22 mean a side that is relatively stretched during the bending, and an inner side means a side that is relatively squeezed during the bending.

Further, as shown in FIG. 1 to FIG. 11, in a cross section C orthogonal to a length direction of the first bent section 12 and the second bent section 22, in the width direction X of the flat tube 100, a largest distance LD1 between the first side surface 103 of the flat tube 100 and an outer wall surface that is of the first bent section 12 and that is on a side adjacent to the first side surface 103 is less than a largest distance LD2 between the second side surface 104 of the flat tube 100 and an outer wall surface that is of the first bent section 12 and that is on a side adjacent to the second side surface 104; and/or a largest distance LD3 between the first side surface 103 of the flat tube 100 and an outer wall surface that is of the second bent section 22 and that is on a side adjacent to the first side surface 103 is less than a largest distance LD4 between the second side surface 104 of the flat tube 100 and an outer wall surface that is of the second bent section 22 and that is on a side adjacent to the second side surface 104. This can facilitate eccentric arrangement of the flat tube 100 and further improve reliability of the flat tube 100.

Specifically, as shown in FIG. 1 to FIG. 7, the first length L1 is greater than or equal to a length Lf1 of a portion, located within the first header 10, of the first side surface 103, and the second length L2 is greater than or equal to a length Ls1 of a portion, located within the first header 10, of the second side surface 104. It should be understood herein that the "portion located within the first header 10" means a length of a portion located within an inner side of an outer periphery of the first header 10. In this way, the first concave part 110 and the second concave part 120 can abut against a wall of the first header 10 or have a gap that is reserved for welding with the wall of the first header 10.

The third length L3 is greater than or equal to a length Lf2 of a portion, located within the second header 20, of the first side surface 103, and the fourth length L4 is greater than or equal to a length Ls2 of a portion, located within the second header 20, of the second side surface 104. It should be understood herein that the "portion located within the second header 20" means a length of a portion located within an inner side of an outer periphery of the second header 20. In this way, the second concave part 130 and the fourth concave part 140 can abut against a wall of the second header 20 or have a gap that is reserved for welding with the wall of the second header 20.

Other configurations and operations of the heat exchanger 1 according to this embodiment of the present application are known to those of ordinary skill in the art, and details are not described herein.

In the description of this specification, descriptions with reference to terms such as "an embodiment", "some embodiments", "example embodiment", "example", "specific example", or "some examples" mean that specific features, structures, materials, or characteristics described with reference to the embodiment or example are included in at least one embodiment or example of the present application. In this specification, illustrative descriptions of the foregoing terms do not necessarily refer to a same embodiment or example. Moreover, the described specific features, structures, materials, or characteristics can be combined in any one or more embodiments or examples in an appropriate manner.

Although the embodiments of the present application are shown and described above, those of ordinary skill in the art can understand that that various changes, modifications, substitutions, and modifications can be made to these embodiments without departing from the principle and purpose of the present application. The scope of the present application is defined by the claims and their equivalents.

The invention claimed is:

1. A heat exchanger, comprising:

a first header, wherein the first header comprises a plurality of openings spaced apart in the length direction of the first header;

a second header, wherein the second header comprises a plurality of openings spaced apart in the length direction of the second header, and the first header and the second header are spaced apart; and a flat tube, wherein the flat tube has a first end section and a second end section that are spaced apart in the length direction of the flat tube, the flat tube has a first side surface and a second side surface that are spaced apart in the width direction of the flat tube, the first side surface of the first end section of the flat tube has a first concave part, the second side surface of the first end section of the flat tube has a second concave part, the first concave part has a first length extending from an end surface of the first end section of the flat tube in the length direction of the flat tube and a first depth extending in the width direction of the flat tube, and the second concave part has a second length extending from the end surface of the first end section of the flat tube in the length direction of the flat tube and a second depth extending in the width direction of the flat tube, wherein the first length is not equal to the second length, the first end section of the flat tube passes through a first corresponding opening of the plurality of openings of the first header and is connected to the first header, and the second end section of the flat tube passes through a second corresponding opening of the plurality of openings of the second header and is connected to the second header, and wherein in a cross section orthogonal to the length direction of the first header, in the width direction of the flat tube, the largest distance between the first side surface of the flat tube and an outer wall surface that is of the first header and that is on a side adjacent to the first side surface is less than the largest distance between the second side surface of the flat tube and an outer wall surface that is of the first header and that is on a side adjacent to the second side surface; or the largest distance between the first side surface of the flat tube and an outer wall surface that is of the second header and that is on a side adjacent to the first side surface is less than the largest distance between the second side surface of the flat tube and an outer wall surface that is of the second header and that is on a side adjacent to the second side surface; or in a cross section orthogonal to the length direction of the first header, in the width direction of the flat tube, the largest distance between the first side surface of the flat tube and an outer wall surface that is of the first header and that is on a side adjacent to the first side surface is less than the largest distance between the second side surface of the flat tube and an outer wall surface that is of the first header and that is on a side adjacent to the second side surface, and the largest distance between the first side surface of the flat tube and an outer wall surface that is of the second header and that is on a side adjacent to the first side surface is less than the largest distance between the second side surface of the flat tube and an outer wall surface that is of the second header and that is on a side adjacent to the second side surface.

2. The heat exchanger according to claim 1, wherein the first header and the second header are selected from the group consisting of round tubes, elliptical tubes, and D-shaped tubes.

3. The heat exchanger according to claim 1, wherein the first side surface of the second end section of the flat tube has a third concave part, the third concave part has a third length extending from an end surface of the second end section of the flat tube in the length direction of the flat tube and a third depth extending in the width direction of the flat tube, the second side surface of the second end section of the flat tube has a fourth concave part, and the fourth concave part has a fourth length extending from the end surface of the second end section of the flat tube in the length direction of the flat tube and a fourth depth extending in the width direction of the flat tube, wherein the second length is greater than the first length, the fourth length is greater than the third length, the first depth is equal to the third depth, and the second depth is equal to the fourth depth.

4. The heat exchanger according to claim 3, wherein the first length is greater than or equal to the length of the first side surface, located within the first header, of the flat tube, the second length is greater than or equal to the length of the second side surface, located within the first header, of the flat tube, the third length is greater than or equal to the length of the first side surface, located within the second header, of the flat tube, and the fourth length is greater than or equal to the length of the second side surface, located within the second header, of the flat tube.

5. The heat exchanger according to claim 1, wherein the first header comprises at least a first bent section, the first end section of the flat tube is connected to the first bent section, the second header comprises at least a second bent section, and the second end section of the flat tube is connected to the second bent section, and wherein the second side surface of the flat tube is closer to an outer side of the first bent section than the first side surface, or the second side surface of the flat tube is closer to an outer side of the second bent section than the first side surface;

or the second side surface of the flat tube is closer to an outer side of the first bent section than the first side surface, and the second side surface of the flat tube is closer to an outer side of the second bent section than the first side surface.

6. A heat exchanger, comprising:

a first header, wherein the first header comprises a plurality of openings spaced apart in the length direction of the first header;

a second header, wherein the second header comprises a plurality of openings spaced apart in the length direction of the second header, and the first header and the second header are spaced apart; and a flat tube, wherein the flat tube has a first end section and a second end section that are spaced apart in the length direction of the flat tube, the flat tube has a first side surface and a second side surface that are spaced apart in the width direction of the flat tube, the first end section of the first side surface of the flat tube has a first concave part, the second end section of the first side surface of the flat tube has a third concave part, the first concave part has a first length extending from an end surface of the first end section of the flat tube in the length direction of the flat tube and a first depth extending in the width direction of the flat tube, and the third concave part has a third length extending from an end surface of the second end section of the flat tube in the length direction of the flat tube and a third depth extending in the width direction of the flat tube, wherein the first length is equal to the third length, the first end section of the flat tube passes through a first corresponding opening of the plurality of openings of the first header and is connected to the first header, and the second end section of the flat tube passes through a second corresponding opening of the plurality of openings of the second header and is connected to the second header, and wherein in a cross section orthogonal to the length direction of the first header, in the width direction of the flat tube, the largest distance between the first side surface of the flat tube and an outer wall surface that is of the first header and that is on a side adjacent to the first side surface is less than the largest distance between the second side surface of the flat tube and an outer wall surface that is of the first header and that is on a side adjacent to the second side surface;

or the largest distance between the first side surface of the flat tube and an outer wall surface that is of the second header and that is on a side adjacent to the first side surface is less than the largest distance between the second side surface of the flat tube and an outer wall surface that is of the second header and that is on a side adjacent to the second side surface;

or in a cross section orthogonal to the length direction of the first header, in the width direction of the flat tube, the largest distance between the first side surface of the flat tube and an outer wall surface that is of the first header and that is on a side adjacent to the first side surface is less than the largest distance between the second side surface of the flat tube and an outer wall surface that is of the first header and that is on a side adjacent to the second side surface, and the largest distance between the first side surface of the flat tube and an outer wall surface that is of the second header and that is on a side adjacent to the first side surface is less than the largest distance between the second side surface of the flat tube and an outer wall surface that is of the second header and that is on a side adjacent to the second side surface.

7. The heat exchanger according to claim 6, wherein the first header and the second header are selected from the group consisting of round tubes, elliptical tubes, and D-shaped tubes.

8. The heat exchanger according to claim 6, wherein the first side surface of the first end section of the flat tube the first concave part, the second side surface of the first end section of the flat tube has a second concave part, the first concave part has the first length extending from an end surface of the first end section of the flat tube in the length direction of the flat tube and the first depth extending in the width direction of the flat tube, the second concave part has a second length extending from the end surface of the first end section of the flat tube in the length direction of the flat tube and a second depth extending in the width direction of the flat tube, the first side surface of the second end section of the flat tube the third concave part, the third concave part has the third length extending from the end surface of the second end section of the flat tube in the length direction of the flat tube and the third depth extending in the width direction of the flat tube, the second side surface of the second end section of the flat tube has a fourth concave part, and the fourth concave part has a fourth length extending from the end surface of the second end section of the flat tube in the length direction of the flat tube and a fourth depth extending in the width direction of the flat tube, wherein the second length is greater than the first length, the fourth length is greater than the third length, the first depth is equal to the third depth, and the second depth is equal to the fourth depth.

9. The heat exchanger according to claim 7, wherein the first length is greater than or equal to the length of the first side surface, located within the first header, of the flat tube, a second length extending from the end surface of the first end section of the flat tube in the length direction of the flat tube is greater than or equal to the length of the second side surface, located within the first header, of the flat tube, the third length is greater than or equal to the length of the first side surface, located within the second header, of the flat tube, and a fourth length extending from the end surface of the second end section of the flat tube in the length direction of the flat tube is greater than or equal to the length of the second side surface, located within the second header, of the flat tube.

* * * * *